US006294773B1

(12) United States Patent
Chung

(10) Patent No.: US 6,294,773 B1
(45) Date of Patent: Sep. 25, 2001

(54) MICROWAVING IN A CAROUSEL WITH MAGNETRONS BELOW A FOOD PRODUCT ISOLATED BY A NONCONDUCTOR

(76) Inventor: Jing-Yau Chung, 3907 Dennis St., Houston, TX (US) 77004

( * ) Notice: Subject to any disclaimer, the term of this patent is extended or adjusted under 35 U.S.C. 154(b) by 0 days.

(21) Appl. No.: 09/615,203

(22) Filed: Jul. 13, 2000

Related U.S. Application Data

(60) Provisional application No. 60/143,785, filed on Jul. 14, 1999.

(51) Int. Cl.[7] ..... H05B 6/78

(52) U.S. Cl. ..... 219/701; 219/700; 219/731; 219/762; 99/451; 99/DIG. 14

(58) Field of Search ..... 219/700, 701, 219/698, 699, 731, 725, 762; 99/451, DIG. 14; 426/241, 243

(56) References Cited

U.S. PATENT DOCUMENTS 4,180,718 * 12/1979 Hanson ..... 219/700
4,246,462 * 1/1981 Meisel ..... 219/700
4,289,792 * 9/1981 Smith ..... 219/700
4,405,850 * 9/1983 Edgar ..... 219/701
5,771,786 * 6/1998 Chung ..... 219/731

* cited by examiner

*Primary Examiner*—Philip H. Leung
(74) *Attorney, Agent, or Firm*—Mark A. Oathout

(57) ABSTRACT

One or more magnetrons may be used directly underneath the foods to be cooked/heated. However, a thin layer of nonconductor, such as a glass is used to physically isolate the magnetrons from the foods while permitting the microwave energy to transmit through the nonconductor. A wave-guide may be used to transmit the microwave energy from one or more magnetrons to a surface adjacent to the food products such that the magnetrons are placed a distance away from the food products. A nonconductor is also used to isolate the wave-guide from the foods.

1 Claim, 2 Drawing Sheets

MICROWAVING IN A CAROUSEL WITH MAGNETRONS BELOW A FOOD PRODUCT ISOLATED BY A NONCONDUCTOR

This application is based upon and claims the benefit of provisional application number 60/143,785 filed Jul. 14, 1999.

BACKGROUND

The current invention involves optional arrangements under the general method of microwave heating described in U.S. Pat. No. 5,771,786 (which is intended to be incorporated herein by reference), entitled "System of Cooking or Heating Food Products with Microwaves and Hot Oil," issued on Jun. 30, 1998 hereinafter referred to as "the invention" and outlined in the current invention by the current inventor. In "the invention", a general microwave heating is used simultaneously with hot oil heating to cook a food product rapidly. The food product is carried in an out of the region of combined microwave and hot oil heating by means of a carousel. It should be noted that the term "heating" used in the article not only means raising the temperature of a food product by heat but also means cooking a food product by means of the heating process.

SUMMARY OF THE INVENTION

The current optional arrangements includes, (a) the use of one or more magnetrons directly underneath the foods to be cooked/heated. However, a thin layer of nonconductor, such as a glass is used to physically isolate the magnetrons from the foods while permitting the microwave energy to transmit through the nonconductor.

(b) the use of a wave-guide to transmit the microwave energy from one or more magnetrons to a surface adjacent to the food products such that the magnetrons are placed a distance away from the food products. A nonconductor is also used to isolate the waveguide from the foods.

Both arrangements of magnetrons described in (a) and (b) above ensure that the magnetrons will not be stained with grease or other food particles during the cooking/heating process.

DETAILED DESCRIPTION

Figure 1:
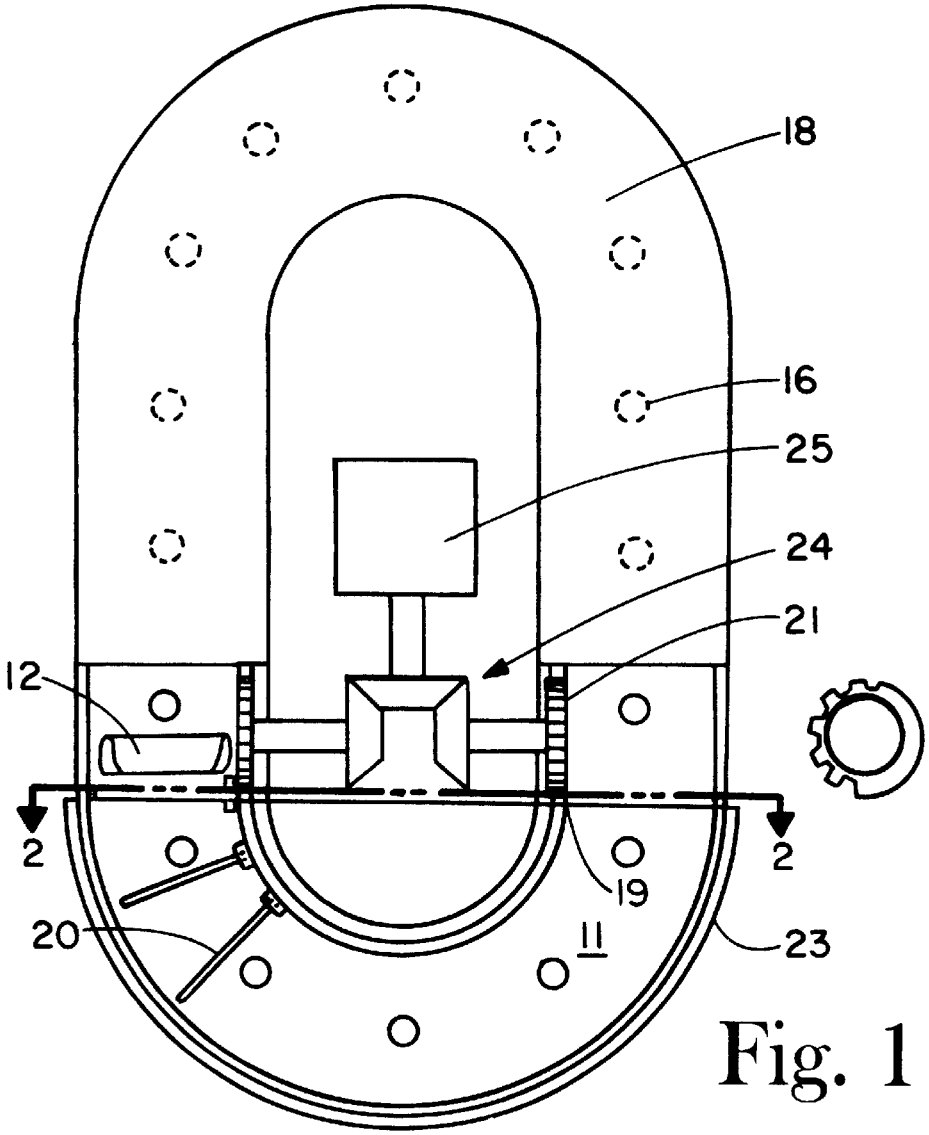
FIG. 1 shows a plan view of one embodiment of the invention.
Figure 2:
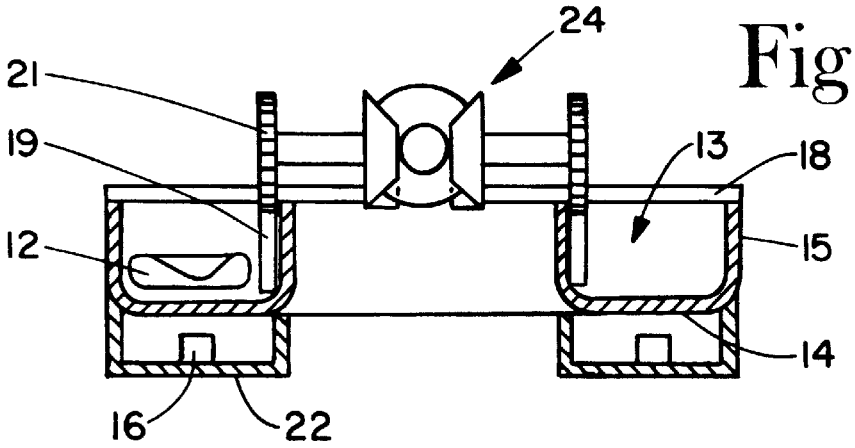
FIG. 2 is a view taken along line 2—2 of FIG. 1.

For arrangement (a) described above, FIG. 1 shows the relative locations of the magnetrons 16 and the foods 12 to be cooked/heated. Depicted in FIG. 1 is the carousel 11 by which the food products 12 are carried in and out of the combined microwave and hot oil cooking/heating region as described in "the invention." The carousel 11 consists of a belt 19 and arms 20 (not all shown). The belt 19 and arms 20 are driven by a driver, such as electric motor 25, and a set of beveled gears 24. The top of belt 19 consists of gear teeth (not shown) through which the belt 19 is driven by a first pair of gears 21. The carousel 11 is placed in a U channel 13 with bottom 14 and side walls 15 as depicted in FIG. 2 (side view of the carousel shown in FIG. 1). The food products 12 normally rest on the bottom 14. The U channel 13 will contain hot oil/grease (not shown). The magnetrons 16 (not limited to, but sixteen are shown) are placed directly underneath carousel 11 with enclosure 22 (such as, for example, a second U-channel made of a conductor) confining the microwave energy. The magnetrons 16 generate an electromagnetic field such that the microwave energy is transmitting towards the bottom 14 of the U channel 13 on which the food products 12 are sliding and rolling. The bottom 14 of the U channel is made of a nonconductor such as a glass which permits the transmission of the microwave energy, yet it isolates the magnetrons from the food products 12 and grease. The U channel 13 is covered by a removable cap 18. Both the side walls 15 and the cap 18 are made of either a conductor or a nonconductor. In the case that side walls 15 and/or cap 18 are made of a nonconductor, however, a choking device, e.g. wire mesh (not shown) shall be placed inside or on the nonconductor material to confine the microwave energy within the U channel 13. It is more desirable, however, to place the wire mesh inside the nonconductor or to be "sandwiched" between two layers of nonconductor such as a glass for easiness in cleaning.

Figure 3:
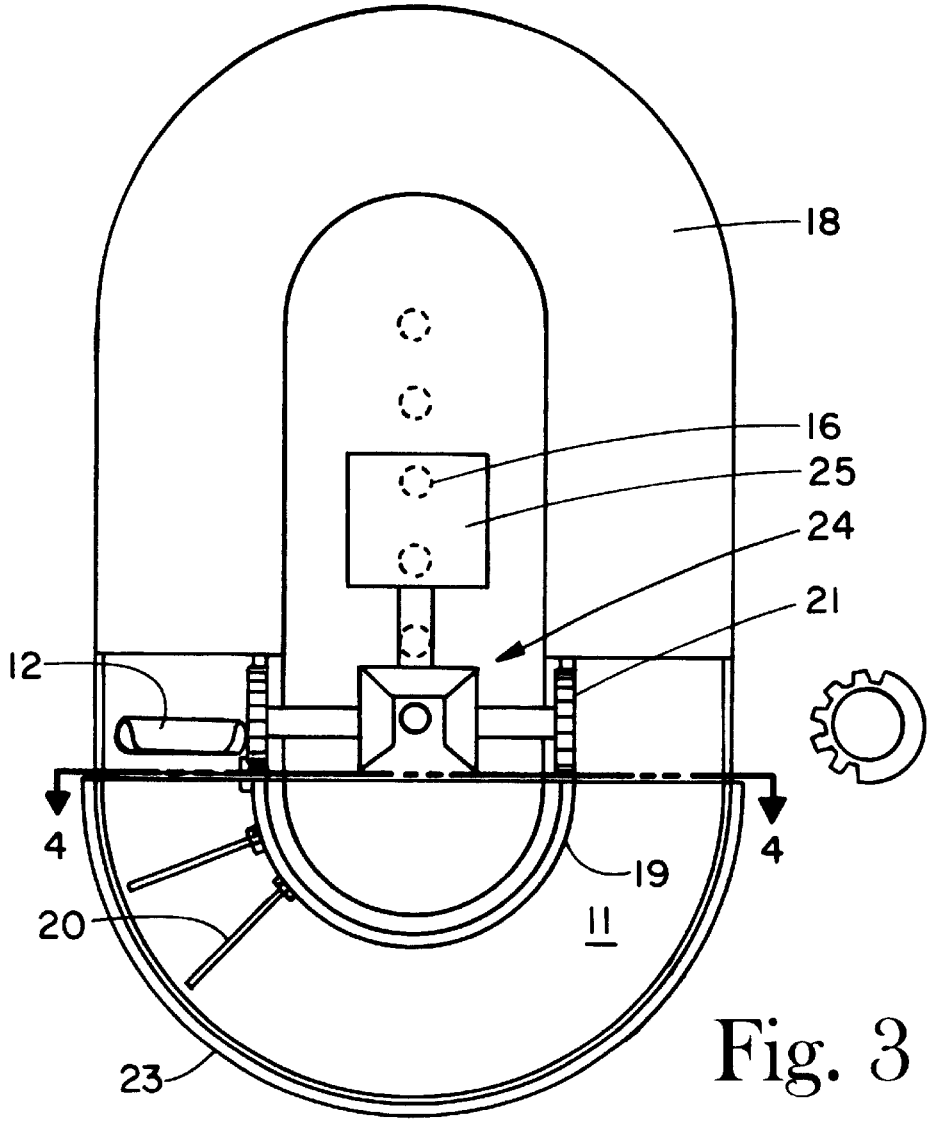
FIG. 3 shows a plan view of another embodiment of the invention.
Figure 4:
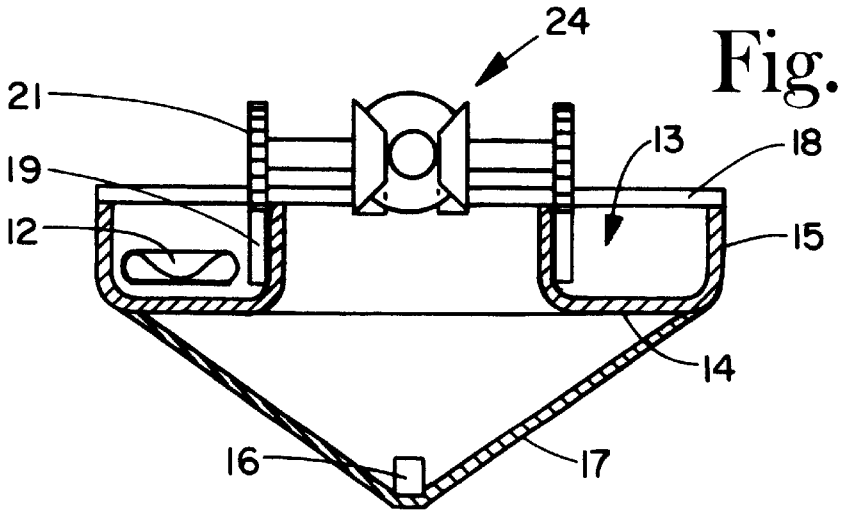
FIG. 4 is a view taken along line 4—4 of FIG. 3.

For arrangement (b) described above and referring to FIGS. 3 and 4, the same carousel 11 with the same driving mechanism is used. The carousel 11 is placed in the same U channel 13 with side walls 15, bottom 14 and a removable cap 18. In this arrangement, however, a wave-guide 17 is used to carry the microwave energy to the bottom 14 of the U channel 13. The magnetron(s) 16 are mounted below the carousel. The wave-guide 17 confines the microwave energy such that it transmits into and towards the bottom 14 of the U channel. After it transmits through the bottom 14 of the U channel, the microwave energy is confined within the U channel as explained in the previous paragraph. The use of the wave-guide 17 makes it possible to isolate or place the magnetrons relatively far away from the bottom 14 of the carousel 11. It also provides flexibility in arranging the magnetron configurations (e.g. six aligned magnetrons shown) and designing an optimum electromagnetic field to be generated by the magnetrons and the wave-guide.

In all arrangements mentioned above:

(a) The gears 21 are covered by a layer of conductor to confine the microwave energy in the U channel 13.

(b) A hinged cover 23 is used to place the food product in carousel 11. An automatic shut-off switch (not shown) is used to shut off the microwave and carousel power sources when the cover 23 is opened.

(c) The magnetrons may be placed on top of the carousel system such that the microwave energy transmits towards the food products 12 from the top. In this case the removable top 18 is not a conductor, permitting the transmission of microwave energy. The bottom 14 of the U channel 13, on the other hand is a conductor or contains wire mesh, confining the microwave energy within the U channel 13.

What is claimed is:

1. An apparatus for microwaving of food products, comprising:

a carousel including a u-shaped channel having a volume of hot oil;

a belt mounted around the carousel;

a plurality of arms attached to the belt and mounted over the carousel;

a gear mechanism connected to the belt;

a motor connected to the gear mechanism;

a removable cap covering the u-shaped channel;

wherein the u-shaped channel is comprised of a bottom and two sidewalls;

wherein the bottom comprises a non-conducting surface;

a wave channel defining a wave path unitary with and below the u-shaped channel; and a source of microwave energy mounted to the wave channel below the carrying means.

* * * * *